US011013974B2

(12) United States Patent
Van Volkenburgh

(10) Patent No.: US 11,013,974 B2
(45) Date of Patent: May 25, 2021

(54) SYSTEMS AND METHODS OF A CLIMBING WALL

(71) Applicant: David Scott Van Volkenburgh, Kansas City, MO (US)

(72) Inventor: David Scott Van Volkenburgh, Kansas City, MO (US)

( * ) Notice: Subject to any disclaimer, the term of this patent is extended or adjusted under 35 U.S.C. 154(b) by 21 days.

(21) Appl. No.: 16/600,995

(22) Filed: Oct. 14, 2019

(65) Prior Publication Data

US 2021/0106894 A1 Apr. 15, 2021

(51) Int. Cl.
*A63B 69/00* (2006.01)

(52) U.S. Cl.
CPC ..... *A63B 69/0048* (2013.01)

(58) Field of Classification Search
CPC ..... A63B 69/0048; A63B 9/00; A63B 27/00–29/08
See application file for complete search history.

(56) References Cited

U.S. PATENT DOCUMENTS

| | | | |
|---|---|---|---|
| 9,017,224 B1 | 4/2015 | Singley | |
| 2005/0164834 A1 | 7/2005 | Paulete | |
| 2008/0300111 A1 | 12/2008 | Meissner | |
| 2019/0009157 A1 | 1/2019 | Sudeith et al. | |
| 2020/0353339 A1 * | 11/2020 | Mealing | A63B 69/0048 |

FOREIGN PATENT DOCUMENTS

| | | |
|---|---|---|
| CN | 107376278 A | 11/2017 |
| KR | 10-1377903 B1 | 3/2014 |
| WO | 2010/132865 A1 | 11/2010 |

OTHER PUBLICATIONS

Zeeland, J. v. (Aug. 6, 2017). Crack Generator 3000. Retrieved from https://www.youtube.com/watch?v=Qvit-thCL6c.

Wideboyz "Hand Built Crack Climbing Volumes", Web Page <https://wideboyz.com/>, 6 pages, Aug. 23, 2018, retrieved from Internet Web Archve Wayback Machine <https://web.archive.org/web/20180823042413/https://wideboyz.com/> on Oct. 15, 2019.

"Adjustable Apparatus for the Movement of Indoor Climbing Cracks", Touchstone Climbing, Retrieved from Internet URL: <https://touchstoneclimbing.com/adjustable-apparatus-for-the-movement-of-indoor-climbing-cracks/>, pp. 1-4 (Apr. 26, 2011).

International Search Report and Written Opinion received for PCT Patent Application No. PCT/US2020/050702, dated Dec. 7, 2020, 12 pages.

* cited by examiner

*Primary Examiner* — Jennifer Robertson
(74) *Attorney, Agent, or Firm* — Shook, Hardy & Bacon L.L.P.

(57) ABSTRACT

Adjustable climbing walls for crack climbing at various gap sizes are provided. The adjustable climbing wall may have two panels and a slide for positioning one panel relative to another. An actuator may adjustably position each of the two panels along the slide. Aspects contemplated methods and systems for the adjustable climbing wall.

20 Claims, 6 Drawing Sheets

SYSTEMS AND METHODS OF A CLIMBING WALL

TECHNICAL FIELD

Aspects hereof relate to climbing equipment.

BACKGROUND

Crack climbing is a type of rock climbing where the climber follows a crack of a rock face and uses specialized techniques. Traditionally, a climber uses pressure, force, and friction to advance up the crack. The size of the crack (e.g., the gap between two surfaces) when climbing the rock face can vary due to natural formations. The techniques used to crack climb can also change dependent on the size of the crack.

BRIEF SUMMARY

Aspects hereof provide for an adjustable climbing wall for crack climbing at various gap sizes. A crack wall is a type of climbing wall for crack climbing that simulates the crack of a rock face. Traditional crack walls have a set gap between two climbing surfaces with each climbing surface mounted to a wall. By mounting both climbing surfaces, traditional crack walls advantageously allow a climber to practice climbing the crack of a rock face. Climbers can apply force to both climbing surfaces and the crack wall will apply an opposite force. However, because each traditional crack wall has a set gap, a climber may use multiple crack walls. Aspects described herein provide an adjustable crack wall that retain the advantages of traditional crack walls while additionally providing an adjustable gap between the two climbing surfaces. Further, aspects described herein maintain rigidity when the crack wall is adjusted to a new gap size.

This summary is provided to enlighten and not limit the scope of methods and systems provided hereafter in complete detail.

BRIEF DESCRIPTION OF THE DRAWINGS

Illustrative embodiments of the present invention are described in detail below with reference to the attached drawing figures, and wherein.

DETAILED DESCRIPTION OF THE INVENTION

The subject matter of the technology described herein is described with specificity to meet statutory requirements. However, the description itself is not intended to limit the scope of this patent. Rather, the inventor has contemplated that the claimed subject matter might also be embodied in other ways, to include different steps or combinations of steps, or additional components or combinations of components, similar to the ones described in this document, in conjunction with other present or future technologies.

Adjustable climbing walls, such as those described herein, can provide a number of benefits to climbers. For example, crack walls are often used to practice the skills related to crack climbing. However, climbers want to practice various techniques at various gap sizes. The gap ideally should not have any obstructions in the gap, as they can get in the way of some crack climbing techniques. With traditional crack walls, climbers purchased multiple crack walls of various static crack widths, which can be cost prohibitive. Further, traditional crack walls can require both climbing surfaces to be mounted to a vertical surface (e.g., a wall) for a climber to ascend the climbing surfaces. Mounting both climbing surfaces to a wall allows for the crack wall to be stable for climbing without any additional supports between the two climbing surfaces that may be an obstruction in the gap. Advantageously, the present invention allows for an adjustable crack wall. The adjustable crack wall can adjust to various gap sizes, no longer requiring climbers to purchase or use various traditional crack walls. The adjustable crack wall of the present disclosure may have only one climbing surface fixedly mounted to the vertical surface and not both climbing surfaces. Further, advantageously this is achieved without obstructions in the gap. Additionally, the adjustable crack wall may be movable between a first and a second gap size, which may include a plurality of gap sizes therebetween.

Figure 1A:
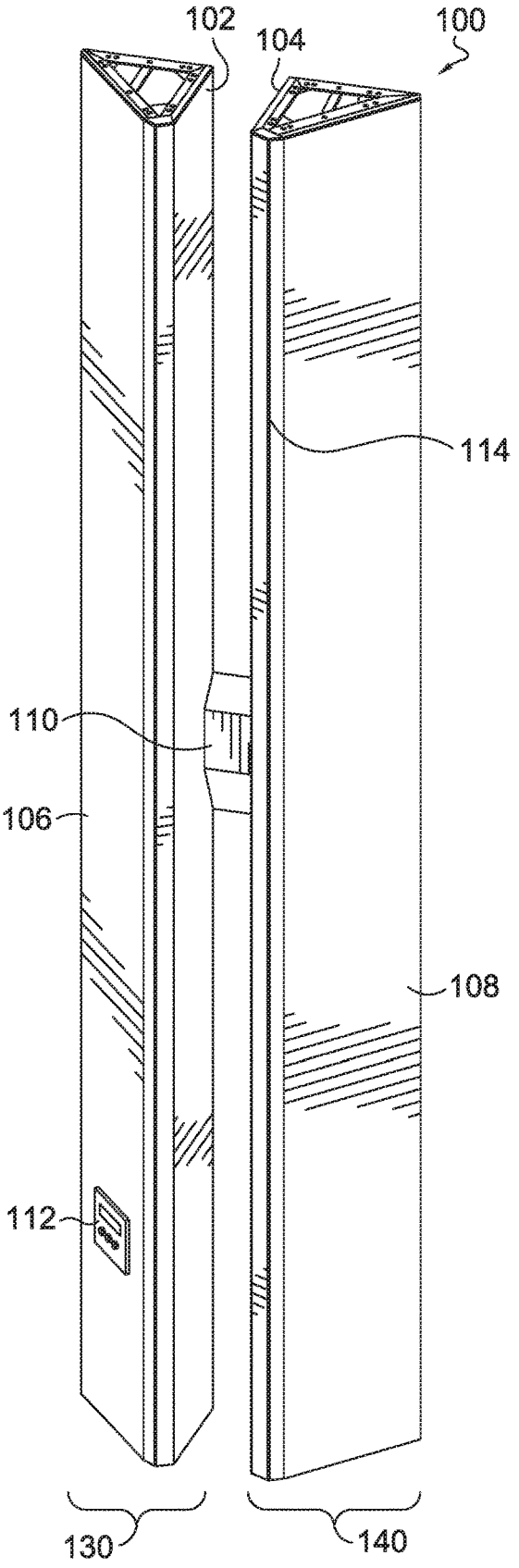
FIGS. 1A and 1B depict various views of an example adjustable climbing wall, according to aspects described herein.
Figure 1B:
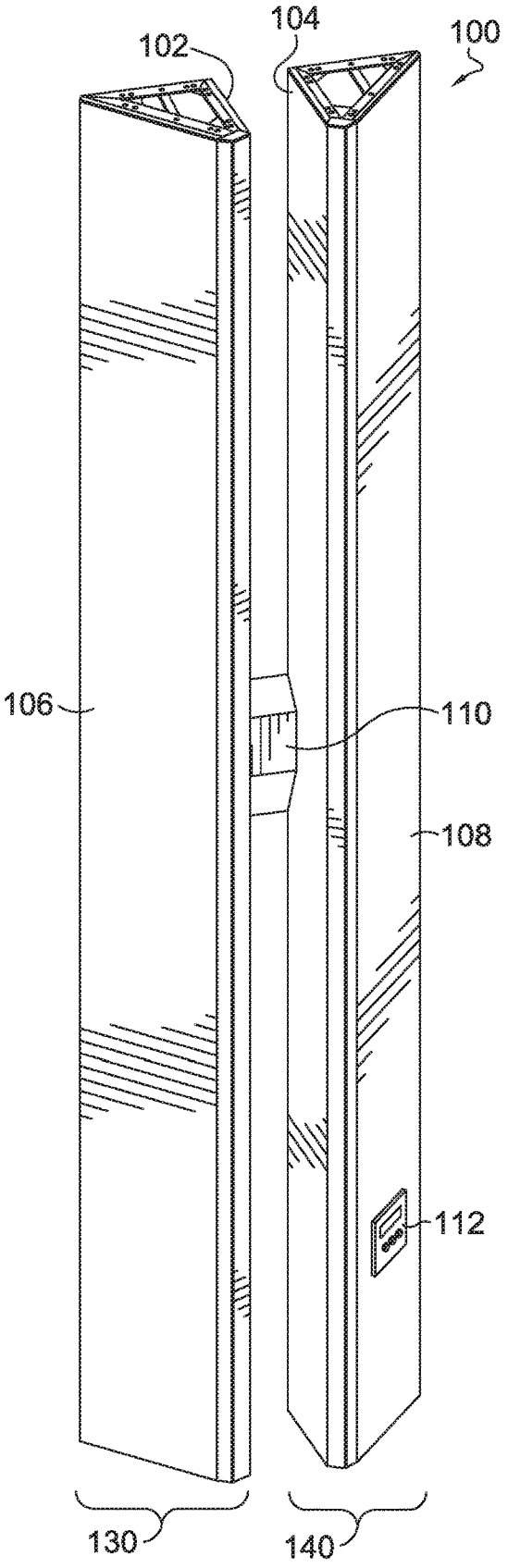
Figure 3A:
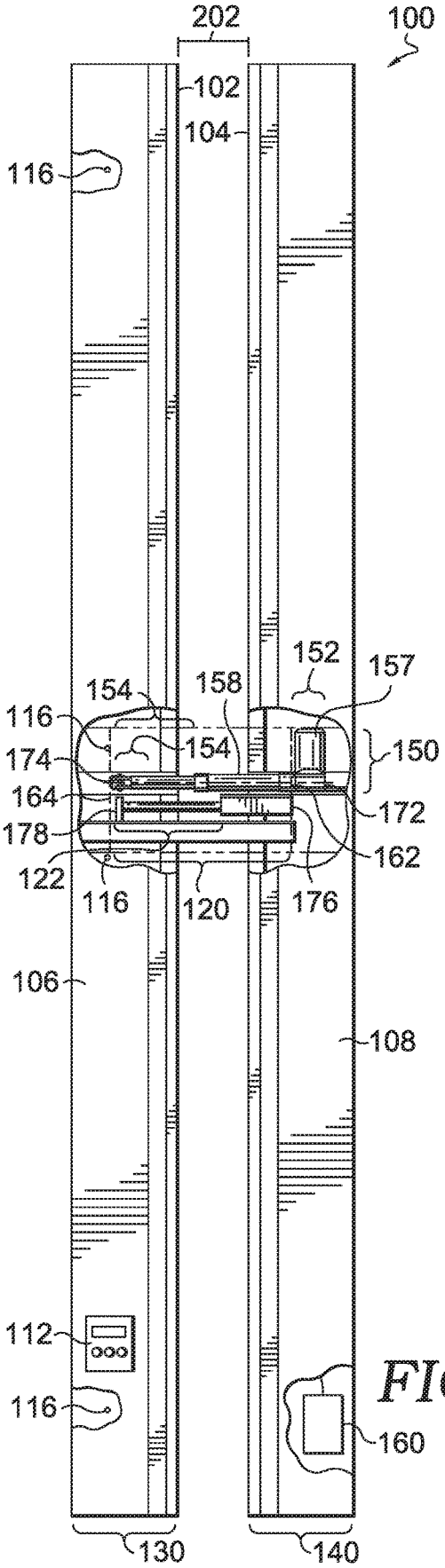
FIG. 3A depicts a front view with a cut away of the adjustable climbing wall of FIGS. 1A and 1B at a second gap distance, according to aspects described herein.
Figure 2A:
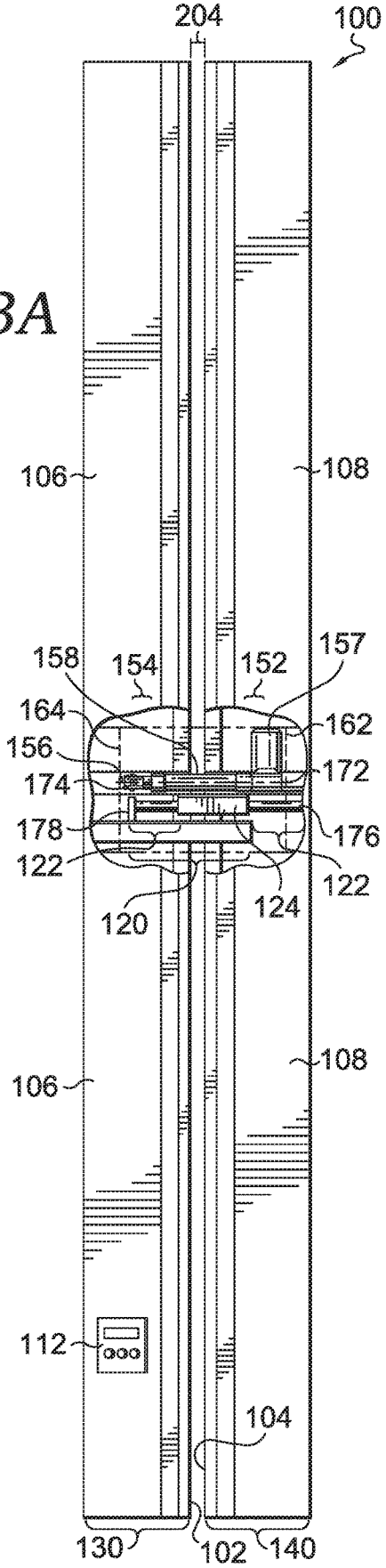
FIG. 2A depicts a front view with a cut away of the adjustable climbing wall of FIGS. 1A and 1B at a first gap distance, according to aspects described herein.
Figure 2B:
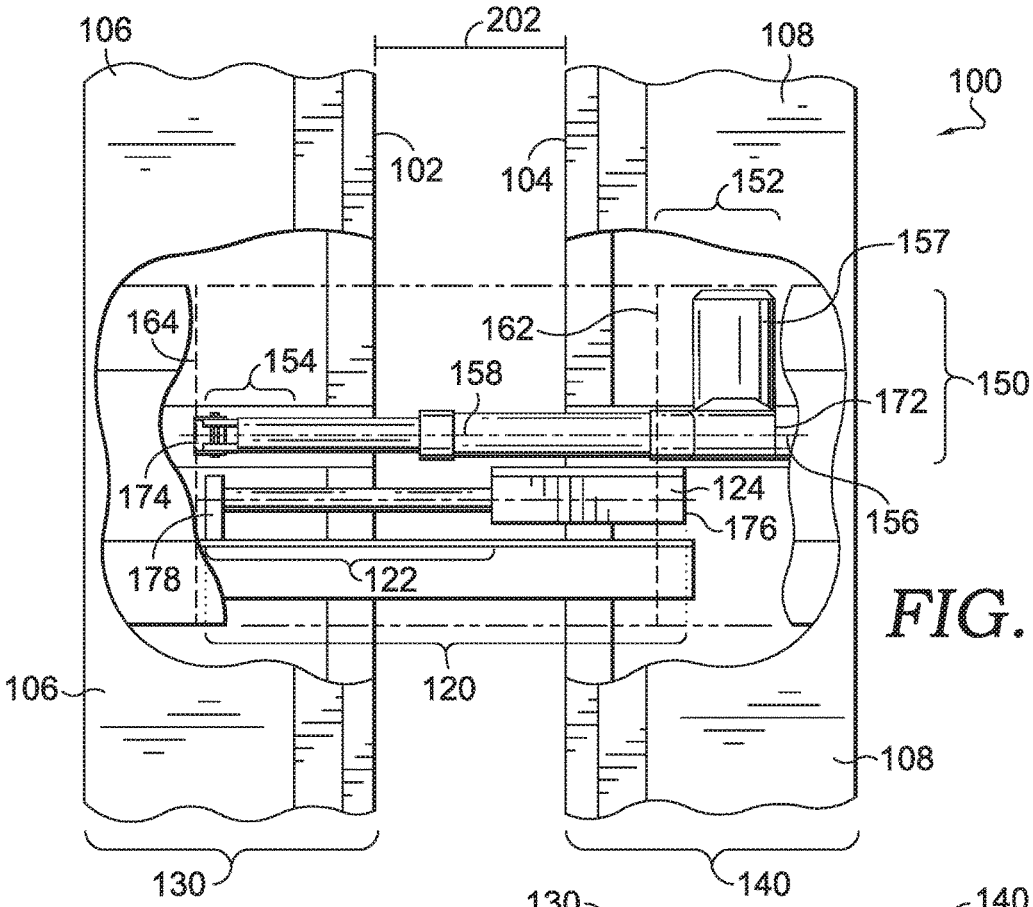
FIG. 2B depicts a magnified view of the cut away portion of the adjustable climbing wall of FIG. 2A, according to aspects described herein.
Figure 3B:
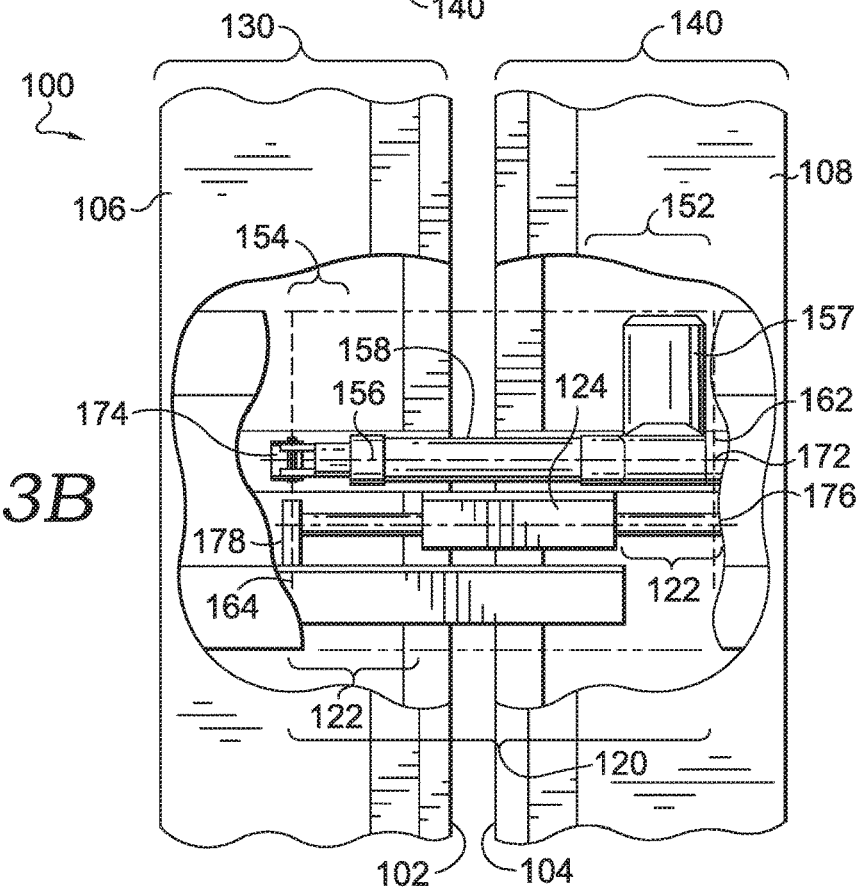
FIG. 3B depicts a magnified view of the cut away portion of the adjustable climbing wall of FIG. 3A, according to aspects described herein.

For example, and in reference to the Figures, such as FIGS. 1A, 1B, 2A, 2B, 3A, and 3B, in some aspects the crack wall described herein comprises a first panel 140 with a first primary surface 104, a second panel 130 with a second primary surface 102, and a slide 120 extending between the first panel 140 and the second panel 130. The distance between the first primary surface 104 and the second primary surface 102 may be defined by a gap (a first distance 202 and a second distance 204 shown in FIGS. 2A and 3A respectively). Generally, the slide 120 comprises an extension element 122 and a receiving element 124, as best seen in FIGS. 2B and 3B. The receiving element 124 may be joined with the first panel 140, the extension element 122 may be joined with the second panel 130. This configuration allows the second panel 130 to be fixed to a vertical surface and adjustably position the first panel 140 relative to the second panel 130. Slide 120 may provide support to the first panel 140, so only the second panel 130 may be fixed to a vertical surface. Additionally, the slide 120 may prevent any obstructions in the gap. For example, a slide 120 may not require support beams in the gap between the first panel 140 and the second panel 130, but instead only the slide 120 (or a plurality of slides described herein) may be used. While the aspects depicted herein depict a the receiving element 124 and the extension element 122 joined with specific panel portions, it is contemplated that they may be joined with either of the panels at any suitable location, in aspects.

As used herein, "slide" refers to any linear motion device. Some linear motion devices comprise an extension element and a receiving element. A slide may include a linear rail and ball bearing slide in some aspects. A slide may also include a rail and rollers or other configurations that facilitate vertical support while allowing horizontal motion.

The term "actuator" refers to a component that is responsible for moving a mechanism or system, such as in a linear direction. Actuators may include an electric actuator, a hydraulic actuator, a pneumatic actuator, or any mechanical or electric device configured to move an object.

The terms "first panel" and "second panel" each refer to a crack wall volume. A crack wall volume refers to an entire structure that includes a climbing surface. Crack wall volumes may be in various shapes and sizes such as square and rectangular.

The terms "first primary surface" and "second primary surface" each refer to a climbing surface. In some aspects the first and second primary surfaces may be substantially flat surfaces, in some aspects each surface may be textured to mimic natural rock formations, or with soft material for more comfortable climbing to a climber.

The term "about" used when, for instance, describing numerical ranges means within 10% of a designated value unless indicated otherwise.

The term "end" is used when, for instance, describing an area proximate the terminal limit of an object or device, and is not limited to a terminal limit unless otherwise described explicitly herein.

With reference to FIGS. 1A, and 1B, an exemplary adjustable climbing wall 100 is provided from a first and second perspective views accordance with aspects described herein. The adjustable climbing wall 100 comprises the first panel 140 with a first primary surface 104 with a first secondary surface 108 and a second panel 130 with a second primary surface 102 and a second secondary surface 106. The first primary surface 104 substantially faces the second primary surface 102. For example, the first primary surface 104 and the second primary surface 102 are substantially parallel, in an example. However, the primary surfaces may deviate from parallel in other examples. The distance between the first primary surface 104 and the second primary surface 102 define a crack or gap to enable crack wall climbing. The distance between the first primary surface 104 and the second primary surface 102 may be separated by the slide 120 (shown in FIGS. 2A, 2B, 3A, and 3B) as described herein.

Continuing with FIGS. 1A and 1B, the first secondary surface 108 and second secondary surface 106 may be formed at an angle with respect to the first primary surface 104 and the second primary surface 102, respectively. Therefore, the combination of the first primary surface 104 with the first secondary surface 108, and the second primary surface 102 and the second secondary surface 106 may each form a triangular structure as viewed from a top or bottom plane of the respective volume. The first secondary surface 108 and the second secondary surface 106 may be provided as a cover and/or frame to protect the components, mechanisms, and devices of the adjustable climbing wall 100. Although the first panel 140 and second panel 130 shown in FIGS. 1A and 1B are shown as a triangular structure, in some aspects the first panel 140 and second panel 130 may be rectangular, or form a different shape.

FIGS. 2A, 2B, 3A, and 3B illustrate a cut away view of the adjustable climbing wall 100, in accordance with aspects hereof. Shown in FIG. 2A are mounting points 116. The mounting points 116 may be used with a securing mechanism, such as a bolt, pin, or other mechanical fastener, to join the second panel 130 to a vertical surface, such as a wall or other climbing surface. The mounting points 116 therefore may fix the second panel 130 while the first panel 140 is adjustably positioned relative to the second panel 130. For example, a vertical position of the first panel 140 is maintained while a transverse position (e.g., horizontal) is adjustable relative to the second panel 130. In some aspects additional mounting points 116 may be present with the second panel 130, or a smaller number of mounting points 116 may be used. Further, it is contemplated that the mounting points 116 may be apertures extending through structural members (e.g., a frame) of the second panel 130 and effective for a mechanical fastener to extend there through for mounting the second panel 130 to a supporting surface.

FIGS. 2A, 2B, 3A, and 3B illustrate the adjustable climbing wall 100 is adjustable along the slide 120. The slide 120 allows the first panel 140 to be adjustably positioned relative to the second panel 130 in a linear direction as defined by a longitudinal axis 156 of the slide 120. Specifically, the first panel 140 may be positioned along the extension element 122 (illustrated in FIGS. 2B and 3B) via the receiving element 124. As shown in FIGS. 2A and 2B, the receiving element 124 is at a first position along the extension element 122, placing the first panel 140 a first distance 202 from the second panel 130. Shown in FIGS. 3A and 3B, the receiving element 124 is at a second position along the extension element 122, placing the first panel 140 at a second distance 204 from the second panel 130. In effect, adjustably positioning the first panel 140 relative to the second panel 130 adjusts the gap size between the first primary surface 104 and the second primary surface 102.

As shown in FIGS. 2A and 3A, the adjustable climbing wall 100 may advantageously allow for a climber to practice at multiple gap sizes on the same climbing wall. The first distance 202 may be about 5.8 inches, about 147.32 millimeters from the first primary surface 104 to the second primary surface 102. The second distance 204 may be about 2 inches about 50.8 millimeters from the first primary surface 104 to the second primary surface 102. The first distance 202 may be the maximum distance and the second distance 204 may be the minimum distance of the adjustable climbing wall 100. In some aspects, the first distance 202 may correspond to an extended position and the second distance 204 may correspond to a second distance 204. The extended position is a distance between the first primary surface 104 and the second primary surface 102 that is greater than the retracted position. In some aspects, the extended position may be the maximum distance between the first primary surface 104 and the second primary surface 102 and the retracted position may be the minimum distance between the first primary surface 104 and the second primary surface 102. In other words, the adjustable climbing wall 100 may be adjusted from the extended position to the retracted position and variations of distances between for various gaps for practicing crack wall climbing and/or storage. Although various distances are described herein, it is contemplated that the minimum and maximum distance between the first primary surface 104 and the second primary surface 102 may be one of any distance corresponding to various gap sizes. For example, in some aspects the maximum distance may be four feet, about 1.22 meters, and the minimum distance may be 0.2 inches, about 5.08 millimeters.

Using a slide 120 as described herein can be advantageous, as the slide 120 may enable the second panel 130 to support the first panel 140 in a vertical direction (e.g., a load bearing direction when used as a crack wall for climbing). For example, the receiving element 124 may be load bearing of the first panel 140. The receiving element 124 receives the extension element 122 which may be joined with the second panel 130 which may be joined with a vertical surface. For example, the receiving element 124 may be a pillow block. The receiving element 124 may be joined to the second panel 130 by a parallel block, directly to the second panel 130, and/or any means of affixing the receiving element 124 to the second panel 130. In some aspects, the receiving element 124 may support at least a portion of the mass of the first panel 140 when the second panel 130 is joined with a vertical surface. When the receiving element 124 is load bearing, the first panel 140 is capable of being adjustably positioned along the length of the extension element 122. Stated differently, the extension element 122 is fixedly joined with one of the panels and the receiving element 124 is fixedly joined with the other panel such that the two panels are slideably engaged via the slideable interaction between the extension element 122 and the receiving element 124. For example, the extension element 122 may be joined with the second panel 130 and the receiving element 124 may be joined with the first panel 140

The slidable engagement allows for the vertical support and therefore vertical consistency while still allowing variability in horizontal positioning between the two panels. In some aspects, the slide 120 serves as a load bearing member allowing the actuator 150 to actuate the first panel 140 relative to the second panel 130 in a horizontal (e.g., perpendicular to the load bearing direction) without (or at least with minimal) load bearing forces acting on the actuator 150.

Returning to FIGS. 2A, 2B, 3A, and 3B, in some aspects, the adjustable climbing wall 100 may comprise the actuator 150. The actuator may have a first actuator end 152 joined with the first panel 140 and a second actuator end 154 joined with the second panel 130. The actuator 150 may position the first panel 140 relative to the second panel 130 by applying a force to move the first panel 140 along the slide 120. Specifically, the actuator 150 may set a gap distance between the first primary surface 104 and the second primary surface 102 by positioning the first primary surface 104 at a position along the extension element 122 via the receiving element 124. In other words, the first primary surface 104 may be adjustably positioned relative to the second primary surface 102 via the actuator 150. For example, the first primary surface 104 may be slidably adjusted to the retracted position at the second distance 204 and to the extended position at the first distance 202 via the actuator 150.

The actuator 150 may comprise an electric actuator. Shown in FIGS. 3A and 3B, the actuator 150 may include a head 157 and a shaft 158. The head 157 may be proximate the first actuator end 152 and the shaft 158 may be proximate the second actuator end 154. The head 157 may include a driver for actuating the shaft 158. The head 157 may adjust the shaft 158 from a first distance 202 from the head 157 to a second distance 204 a greater length from the first distance 202.

The actuator 150 and the slide 120 may be parallel to each other. Specifically, a longitudinal axis, such as longitudinal axis 156 may extend between the first actuator end 152 and the second actuator end 154. The longitudinal axis 156 of the actuator 150 may be parallel with the extension element 122, as defined by an axis extending between the terminal ends of the extension element 122. By keeping the longitudinal axis 156 parallel with the extension element 122, the first panel 140 may be positioned using the combination of the slide 120 and the actuator 150.

In combination, the actuator 150 and the slide 120 provide a horizontal (e.g., left to right) movement of the first panel 140 and second panel 130 relative to one another while maintaining a vertical (e.g., up to down) position of the first panel 140 and the second panel 130. The slide 120 provides the vertical stability while the actuator 150 provide the horizontal movement positioning. Because the slide 120 provides at least the majority of vertical support to the first panel 140, the actuator 150 may be selected based on ability to provide the horizontal movement alone and not also relied on to provide some or all of the vertical support. Therefore, the combination of the actuator 150 and the slide 120 allows for appropriate actuator 150 actuation and resulting space savings within the panels due to a potentially smaller size of the actuator 150 used.

Illustrated in FIGS. 1A, 2A, and 3A, mounted to the second panel 130 is a controller 112. The controller 112 may be logically coupled (e.g., wired or wireless) to an actuator 150 for positioning the first primary surface 104 relative to the second primary surface 102. For example, in some aspects the controller 112 may be electronically coupled to the actuator 150 with a power source 160 to slidably adjust the first primary surface 104 relative to the second primary surface 102. As shown in FIG. 1B, in some aspects the controller 112 may be mounted to the first panel 140. The controller 112 may include a processor and memory configured to control the actuator 150 between one or more positions.

The actuator 150 may not only position the first primary surface 104 relative to the second primary surface 102, but also maintain the gap distance between the two surfaces. When a climber climbs the adjustable climbing wall 100, the climber exerts a force on each of the first primary surface 104 and the second primary surface 102 in at least an opposing horizontal direction. Stated differently, a force experienced by a crack wall during a climb is at least a force separating (e.g., increasing a distance between) the first panel 140 and the second panel 130. As described herein, the second panel 130 may be mounted to a vertical surface while the first panel 140 may be adjustable. The actuator 150 may oppose the force exerted on each of the first primary surface 104 and the second primary surface 102 to maintain a consistent and set gap during a climbing session. For example, the actuator 150 may maintain the first distance 202. In some aspects where the actuator 150 is mechanical, the opposing force may be a mechanical force.

It is contemplated that a set distance or gap may be maintained with additional or alternative mechanisms. For example, a mechanical latch, brake, compression, or other engagement may be implemented to supplement or exclusively provide an effective force resistant to forces generated during climbing. The gap may be maintained by independent mechanism or the gap may be maintained by the slide 120 having a lock or other brake-like feature.

While the actuator 150 is described and depicted with a specific relative configuration to the first panel 140 and the second panel 130, the orientation and position of the actuator 150 may be changed. For example, the head 157 may be positioned proximate the first panel 140 or the second panel 130, in aspects herein.

A cover plate 110 may at least partially obscure the slide 120 or the actuator 150 when viewed from a distal end 114 (e.g., front view) of the first panel 140. In some aspects the cover plate 110 may at least partially obscure the slide 120 and the actuator 150 when viewed from a distal end 114 (shown in FIG. 1A) of the first panel 140. The cover plate 110 may be joined with the first panel 140 and slidably engaged with the second panel 130. The second panel 130 may include a receiving cavity for receiving the cover plate 110 as the second panel 130 is adjustably positioned relative to the first panel 140.

The first secondary surface 108 and second secondary surface 106 may obscure components of the present disclosure when viewed from a distal end 114 of the first panel 140. Advantageously, obscuring components of the present disclosure may provide additional safety to a climber that components of the adjustable climbing wall 100 do not interfere with the climber's actions. For example, if components and devices such as the extension element 122 are external to the first secondary surface 108 or second secondary surface 106, a climber may place their foot onto the extension element 122 for an unfair advantage when climbing. Alternatively, an extension element 122 external to the first secondary surface 108 or second secondary surface 106 may be hazardous as a climber falls from the adjustable climbing wall 100. In each of these examples, a climber may be endangered or the components described herein may be in danger from the climber.

In some aspects the first secondary surface 108 and the second secondary surface 106 may obscure at least a portion of the actuator 150. In some aspects, the first actuator end 152 may comprise a first actuator terminal limit 172 and the second actuator end 154 may comprise a second actuator terminal limit 174. The first actuator terminal limit 172 may be housed within the first panel 140 and the second actuator terminal limit 174 may be housed within the second panel 130. When the first panel 140 is at a first distance 202 or a second distance 204, each of the first actuator terminal limit 172 and the second actuator terminal limit 174 may remain housed within the first panel 140 and second panel 130, respectively. In this way, the first actuator terminal limit 172 and second actuator terminal limit 174 are obscured from view and protected from a climber. Similarly, the head 157 may be obscured by the first secondary surface 108 and protected from endangering a climber.

In some aspects the slide 120 may at least partially be obscured by the first secondary surface 108 and the second secondary surface 106. The slide 120 may comprise a first slide terminal limit 176 proximate the receiving element 124 and a second slide terminal limit 178 proximate the extension element 122. The first slide terminal limit 176 may be housed within the first panel 140. The first slide terminal limit 176 may be housed in the first panel 140 and the second slide terminal limit 178 may be housed in the second panel 130. When the first panel 140 is a first distance 202 or a second distance 204, each of the first slide terminal limit 176 or second slide terminal limit 178 may be housed in the first panel 140 and the second panel 130, respectively. In this way, the first slide terminal limit 176 and second slide terminal limit 178 may be obscured from view and protected from the climber.

At least a portion of the cover plate 110 may be obscured by the first secondary surface 108 and the second secondary surface 106. For example, as the first panel 140 is positioned relative to the second panel 130, the cover plate 110 may be received in the first panel 140. In some aspects, the cover plate 110 may comprise a first cover terminal limit 162 housed in the first panel 140 and a second cover terminal limit 164 housed in the second panel 130. In some aspects, each of the first cover terminal limit 162 and the second cover terminal limit 164 may be housed within the first panel 140 and the second panel 130 (respectively) when the first panel 140 and second panel 130 are at the first distance 202 and the second distance 204. For example, when the first panel 140 and second panel 130 are at a second distance 204, the first cover terminal limit 162 and second cover terminal limit 164 may be obscured by the first secondary surface 108 and the second secondary surface 106.

Figure 4A:
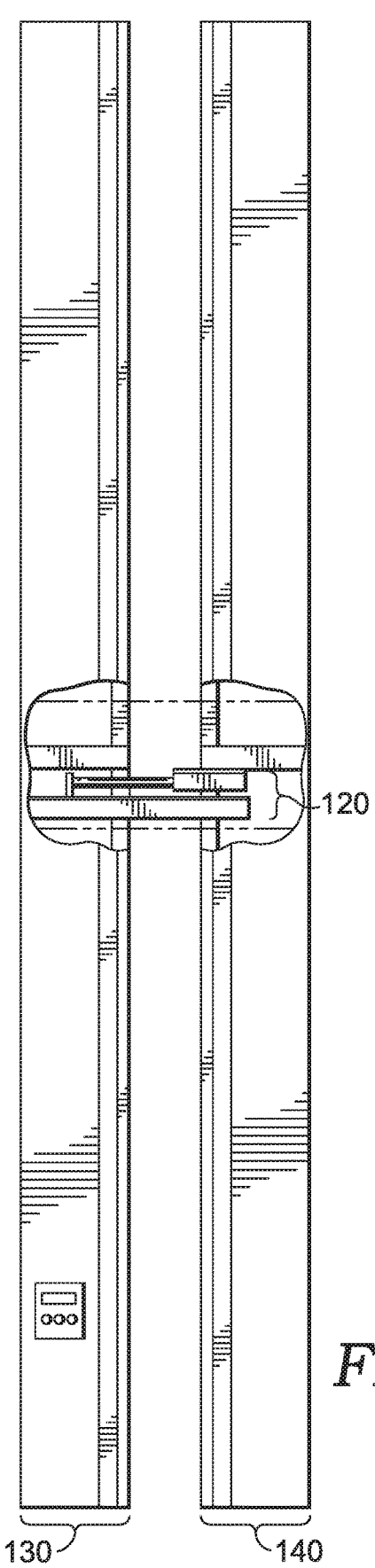
FIG. 4A depicts a front view with a cutaway of an example adjustable climbing wall with a slide, according to aspects described herein.
Figure 4B:
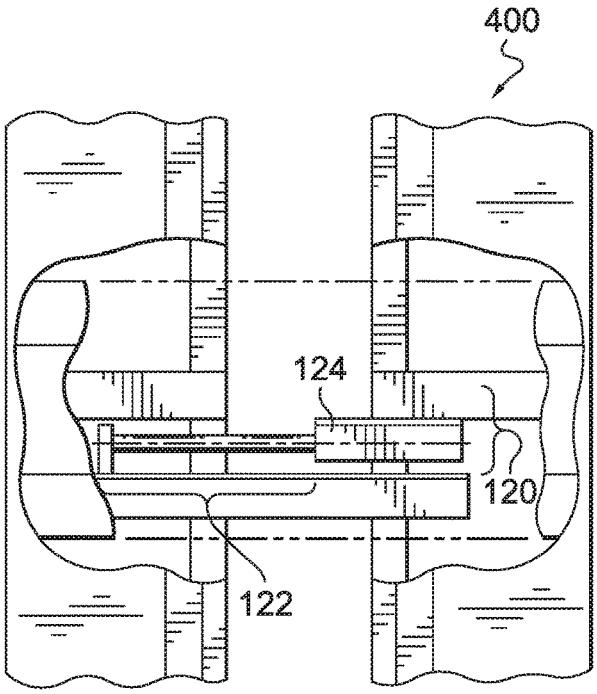
FIG. 4B depicts a magnified view of the cut away portion of the adjustable climbing wall of FIG. 4A, according to aspects described herein.

FIGS. 4A and 4B depict an example adjustable climbing wall 400 with an exemplary slide 120, according to aspects described herein. Elements and components of FIGS. 4A and 4B may be similar in function and composition as described with respect to FIGS. 2A, 2B, 3A, and 3B. The slide 120 may comprise the extension element 122 and the receiving element 124 to adjustably position the first panel 140 relative to the second panel 130. FIGS. 4A and 4B are illustrated without the actuator 150 (described in FIGS. 2A, 2B, 3A, 3B), illustrating one aspect of the present disclosure where manual or mechanical means may be used to adjustably position the first panel 140 relative to the second panel 130.

Figure 5:
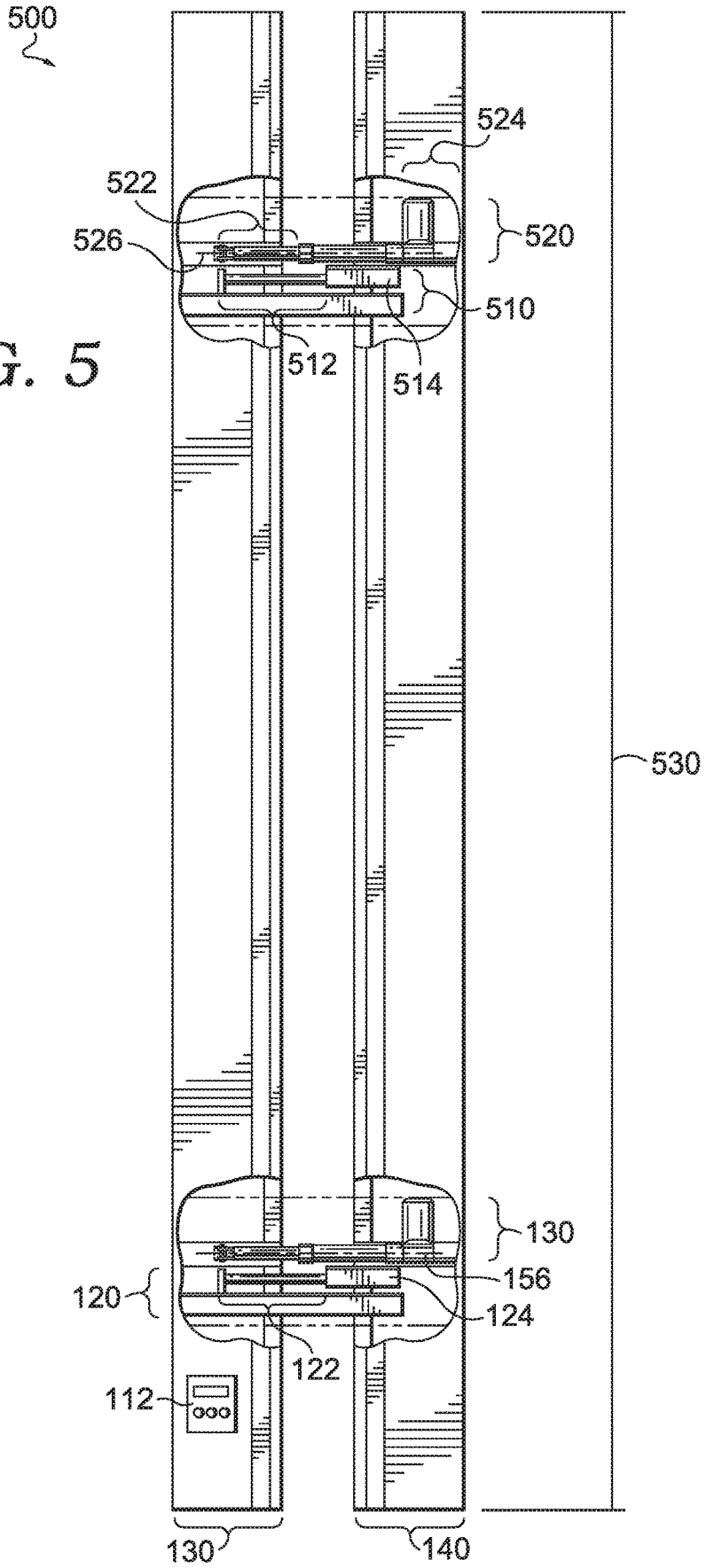
FIG. 5 depicts a front view with cut away portions of an adjustable climbing wall with a plurality of slides and actuators, according to aspects described herein.

FIG. 5 depicts an example adjustable climbing wall 500 with a plurality of slides and actuators, according to aspects described herein. FIG. 5 may comprise similar features and components as FIGS. 1, 2A, 2B, 3A, and 3B. FIG. 5 is illustrated with an additional slide 510 with an additional extension element 512 and an additional receiving element 514. The additional extension element 512 may be joined with the first panel 140, and the additional receiving element 514 may be joined with the second panel 130. The additional extension element 512 may be slidably engaged with the additional receiving element 514.

FIG. 5 also comprises an additional actuator 520 with a first additional actuator end 522 and a second additional actuator end 524. The first additional actuator end 522 may be joined with the first panel 140 and the second additional actuator end 524 may be joined with the second panel 130. An additional longitudinal axis 526 may extend between the first additional actuator end 522 and the second additional actuator end 524. The additional extension element 512 and the additional longitudinal axis 526 may be parallel. In some aspects the additional extension element 512, additional longitudinal axis 526, the longitudinal axis 156 and the extension element 122 may be parallel. In this way, the actuator 150 and additional actuator 520 may simultaneously position the first panel 140 relative to the second panel 130. For example, the actuator 150 and additional actuator 520 may work in tandem to simultaneously move the first panel 140 along the slide 120 and the additional slide 510.

Also shown in FIG. 5 is the controller 112. The controller 112 may be configured to simultaneously adjust the position of each of the first panel 140 and the second panel 130 with each of the actuator 150 and the additional actuator 520. In some aspects, the controller 112 may position supplemental actuators associated with additional adjustable climbing walls. For example, supplemental adjustable climbing walls may be linked to controller 112. In other words, supplemental adjustable climbing walls may be controlled by a common controller, such as the controller 112.

In some aspects the adjustable climbing wall's 500 first panel 140 and second panel 130 may each include a height 530 defining the amount of vertical climbing space useable along the adjustable climbing wall 500. The height 530 may be about eight feet (about 2.44 meters), although it is contemplated in some aspects the height 530 may be six feet (about 1.82 meters). It is contemplated that a height of a panel may be any length, such as less than six feet, greater than eight feet, and any distance in between. Supplemental adjustable climbing walls may enable additional height to be achieved by the adjustable climbing wall, allowing a climber to practice at a greater vertical distance than a single adjustable climbing wall 500 may achieve.

Figure 6:
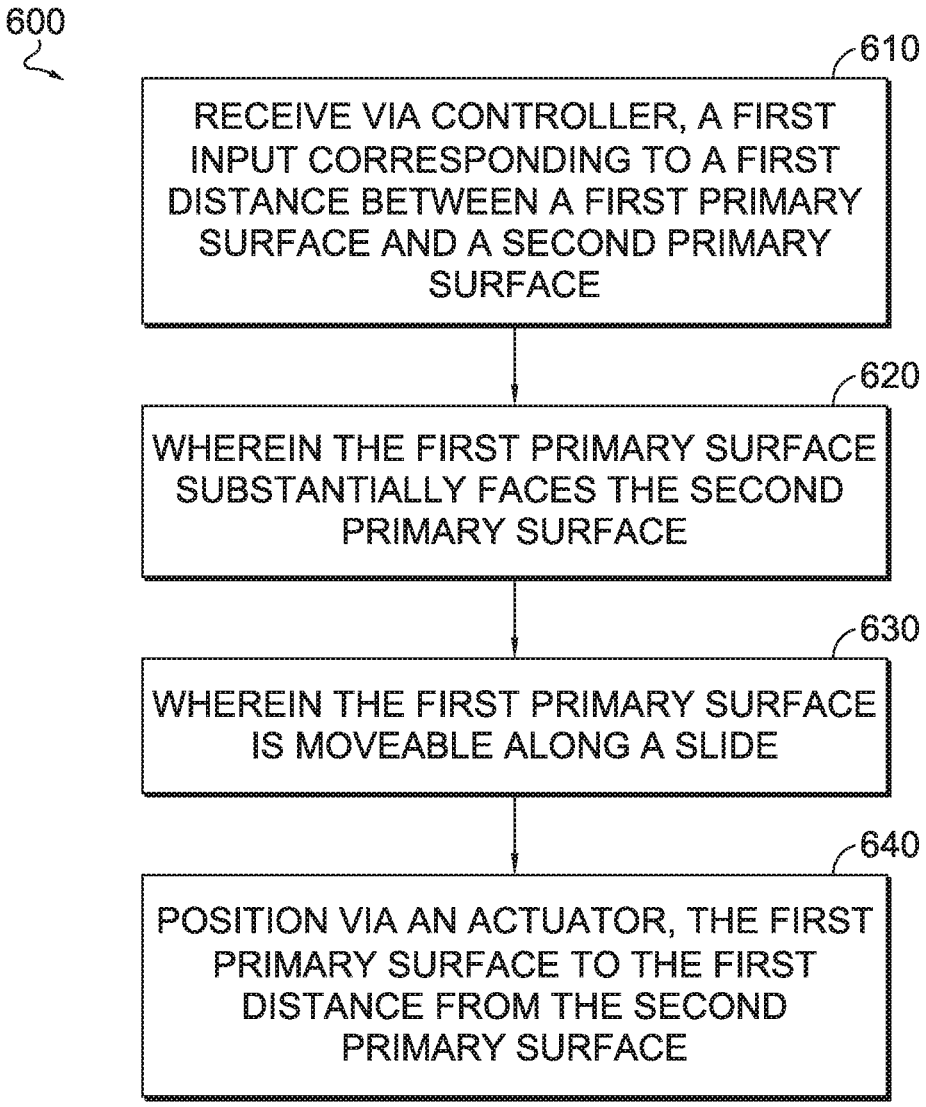
FIG. 6 depicts a method of adjusting a climbing wall, according to aspects described herein.

FIG. 6 depicts a method of adjusting a climbing wall, according to aspects described herein. In some aspects, method 600 may be facilitated by the adjustable climbing wall 100.

Method 600 begins at block 610 by receiving, via a controller, a first input corresponding to a first distance between a first primary surface and a second primary surface. In some aspects, the first distance corresponds to first distance 202, a first primary surface corresponds to the first primary surface 104, the controller refers to the controller 112, and the second primary surface refers to the second primary surface 102 of FIGS. 1A, 1B, 2A, 2B, 3A, and 3B.

At block 620, with references to FIGS. 1A and 1B, the first primary surface 104 substantially faces the second primary surface 102.

At block 630, with reference to FIGS. 2A, 2B, 3A, and 3B, the first primary surface 104 is movable along a slide 120. For example, the first primary surface 104 is movable along the slide 120 having an extension element 122 and a receiving element 124. The extension element 122 may be joined with the first primary surface 104, the extension element 122 may be slidably engaged with the receiving element 124.

At block 640, with reference to FIGS. 2A and 3A, position via an actuator 150 the first primary surface 104 to the first distance 202 from the second primary surface 102. For example, in response to the first input, positioning, via the actuator 150, the first primary surface 104 from the second primary surface 102. Positioning as described herein may comprise moving, via the actuator 150, the first primary surface 104 by sliding the extension element 122 along the receiving element 124. The actuator 150 may comprise a first actuator end 152 and a second actuator end 154. The first actuator end 152 may be joined with the first primary surface 104 and the second actuator end may be joined with the second primary surface 102. In some aspects, the controller 112 may receive a second input corresponding to a second distance 204. In response to the second input, the actuator 150 may position the first primary surface 104 to the second distance 204 from the second primary surface 102.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. An adjustable climbing wall, comprising: a first panel having a first primary surface; a second panel having a second primary surface, wherein the first primary surface substantially faces the second primary surface; a slide having an extension element and a receiving element, the extension element joined with the first panel and the receiving element joined with the second panel, the extension element slidably engaged with the receiving element; and an actuator having a first actuator end and a second actuator end, the first actuator end joined with the first panel, the second actuator end joined with the second panel, wherein a longitudinal axis extending between the first actuator end and the second actuator end is parallel with the extension element.

Clause 2. The adjustable climbing wall of any of the preceding clauses, wherein the first primary surface is adjustably positioned relative to the second primary surface via the actuator.

Clause 3. The adjustable climbing wall of any of the preceding clauses, wherein the actuator further comprises a head proximate to the first actuator end and a shaft at the second actuator end.

Clause 4. The adjustable climbing wall of any of the preceding clauses, wherein the first actuator end is a first actuator terminal limit, and the second actuator end is a second actuator terminal limit.

Clause 5. The adjustable climbing wall of any of the preceding clauses, wherein the slide comprises a first slide terminal limit and a second slide terminal limit, and wherein the first slide terminal limit is housed within the first panel and the second slide terminal limit is housed within the second panel.

Clause 6. The adjustable climbing wall of any of the preceding clauses, further comprising a controller for positioning, via the actuator, the first primary surface relative to the second primary surface.

Clause 7. The adjustable climbing wall of any of the preceding clauses, wherein the positioning is between about 2-5.8 inches from the first primary surface to the second primary surface.

Clause 8. The adjustable climbing wall of any of the preceding clauses, wherein the first primary surface is slidably adjusted to a retracted position and an extended position via the actuator, wherein the extended position is a first distance between the first primary surface and the second primary surface that is greater than a second distance between the first primary surface and the second primary surface in the retracted position.

Clause 9. The adjustable climbing wall of any of the preceding clauses, further comprising a controller electronically coupled to the actuator and a power source configured capable to manage the actuator to slidably adjust the first primary surface, the controller comprising a first preset associated with the extended position and a second preset associated with a retracted position.

Clause 10. The adjustable climbing wall of any of the preceding clauses, further comprising a cover plate joined with the first panel and slidably engaged with the second panel, and wherein the actuator and the slide are at least partially obscured as viewed from a distal end of the first panel.

Clause 11. The adjustable climbing wall of any of the preceding clauses, further comprising a cover plate with a first cover terminal limit and a second cover terminal limit, wherein the first cover terminal limit is housed within the first panel, and wherein the second cover terminal limit is housed within the second panel.

Clause 12. The adjustable climbing wall of any of the preceding clauses, further comprising: an additional slide having an additional extension element and an additional receiving element, the additional extension element joined with the first panel and the additional receiving element joined with the second panel, the additional extension element slidably engaged with the additional receiving element; and an additional actuator having a first additional actuator end and a second additional actuator end, the first additional actuator end joined with the first panel, the second additional actuator end joined with the second panel, wherein an additional longitudinal axis extends between the first additional actuator end and the second additional actuator end, and the longitudinal axis, and the extension element are parallel.

Clause 13. The adjustable climbing wall of any of the preceding clauses, wherein the receiving element is at least partially load bearing of the first panel.

Clause 14. An adjustable climbing wall, comprising: a first panel having a first primary surface; a second panel having a second primary surface, wherein the first primary surface substantially faces the second primary surface; and a slide having an extension element and a receiving element, the extension element joined with the first panel and the receiving element joined with the second panel, the extension element slidably engaged with the receiving element, wherein the first primary surface is slidably adjustable to a retracted position and an extended position, wherein the extended position is a first distance between the first primary surface and the second primary surface that is greater than the second distance in the retracted position.

Clause 15. The adjustable climbing wall of any of the preceding clauses, wherein the slide comprises a first slide terminal limit and a second slide terminal limit, wherein the first slide terminal limit is housed within the first panel, and the second slide terminal limit is housed within the second panel.

Clause 16. The adjustable climbing wall of any of the preceding clauses, wherein the retracted position is about two inches or less between the first primary surface and the second primary surface, and the extended position is about 5.8 inches or less between the first primary surface and the second primary surface.

Clause 17. The adjustable climbing wall of any of the preceding clauses, further comprising a cover plate joined with the first panel and slidably engaged with the second panel, and wherein the slide is at least partially obscured as viewed from a distal end of the first panel, and wherein the cover plate comprises a first cover terminal limit housed in the first panel and a second cover terminal limit housed in the second panel.

Clause 18. A method of adjusting a climbing wall comprising: receiving via a controller, a first input corresponding to a first distance between a first primary surface and a second primary surface, wherein: the first primary surface substantially faces the second primary surface; the first primary surface is movable along a slide having an extension element and a receiving element, the extension element joined with the first primary surface and the receiving element joined with the second primary surface, the extension element slidably engaged with the receiving element; and in response to the first input, positioning, via an actuator, the first primary surface to the first distance from the second primary surface, the actuator comprising a first actuator end and a second actuator end, the first actuator end joined with the first primary surface and the second actuator end joined with the second primary surface.

Clause 19. The method of any of the preceding clauses, further comprising: receiving by the controller, a second input corresponding to a second distance; and in response to the second input, positioning, via an actuator, the first primary surface to the second distance from the second primary surface.

Clause 20. The method of any of the preceding clauses, wherein positioning comprises moving, via the actuator, the first primary surface by sliding the extension element along the receiving element.

What is claimed is:

1. An adjustable climbing wall, comprising:

a first panel having a first primary surface;

a second panel having a second primary surface, wherein the first primary surface substantially faces the second primary surface;

a slide having an extension element and a receiving element, the extension element joined with the first panel and the receiving element joined with the second panel, the extension element slidably engaged with the receiving element; and an actuator having a first actuator end and a second actuator end, the first actuator end joined with the first panel, the second actuator end joined with the second panel, wherein a longitudinal axis extending between the first actuator end and the second actuator end is parallel with the extension element.

2. The adjustable climbing wall of claim 1, wherein the first primary surface is adjustably positioned relative to the second primary surface via the actuator.

3. The adjustable climbing wall of claim 1, wherein the actuator further comprises a head proximate to the first actuator end and a shaft at the second actuator end.

4. The adjustable climbing wall of claim 1, wherein the first actuator end is a first actuator terminal limit, and the second actuator end is a second actuator terminal limit.

5. The adjustable climbing wall of claim 1, wherein the slide comprises a first slide terminal limit and a second slide terminal limit, and wherein the first slide terminal limit is housed within the first panel and the second slide terminal limit is housed within the second panel.

6. The adjustable climbing wall of claim 1 further comprising a controller for positioning, via the actuator, the first primary surface relative to the second primary surface.

7. The adjustable climbing wall of claim 6, wherein the positioning is between about 2-5.8 inches from the first primary surface to the second primary surface.

8. The adjustable climbing wall of claim 1, wherein the first primary surface is slidably adjusted to a retracted position and an extended position via the actuator, wherein the extended position is a first distance between the first primary surface and the second primary surface that is greater than a second distance between the first primary surface and the second primary surface in the retracted position.

9. The adjustable climbing wall of claim 8 further comprising a controller electronically coupled to the actuator and a power source capable to manage the actuator to slidably adjust the first primary surface, the controller comprising a first preset associated with the extended position and a second preset associated with a retracted position.

10. The adjustable climbing wall of claim 1 further comprising a cover plate joined with the first panel and slidably engaged with the second panel, and wherein the actuator and the slide are at least partially obscured as viewed from a distal end of the first panel.

11. The adjustable climbing wall of claim 1 further comprising a cover plate with a first cover terminal limit and a second cover terminal limit, wherein the first cover terminal limit is housed within the first panel, and wherein the second cover terminal limit is housed within the second panel.

12. The adjustable climbing wall of claim 1 further comprising:

an additional slide having an additional extension element and an additional receiving element, the additional extension element joined with the first panel and the additional receiving element joined with the second panel, the additional extension element slidably engaged with the additional receiving element; and an additional actuator having a first additional actuator end and a second additional actuator end, the first additional actuator end joined with the first panel, the second additional actuator end joined with the second panel, wherein an additional longitudinal axis extends between the first additional actuator end and the second additional actuator end, and the longitudinal axis, and the extension element are parallel.

13. The adjustable climbing wall of claim 1, wherein the receiving element is at least partially load bearing of the first panel.

14. An adjustable climbing wall, comprising:

a first panel having a first primary surface;

a second panel having a second primary surface, wherein the first primary surface substantially faces the second primary surface; and a slide having an extension element and a receiving element, the extension element joined with the first panel and the receiving element joined with the second panel, the extension element slidably engaged with the receiving element, wherein the first primary surface is slidably adjustable to a retracted position and an extended position, wherein the extended position is a first distance between the first primary surface and the second primary surface that is greater than a second distance in the retracted position.

15. The adjustable climbing wall of claim 14, wherein the slide comprises a first slide terminal limit and a second slide terminal limit, wherein the first slide terminal limit is housed within the first panel, and the second slide terminal limit is housed within the second panel.

16. The adjustable climbing wall of claim 14, wherein the retracted position is about two inches or less between the first primary surface and the second primary surface, and the extended position is about 5.8 inches or less between the first primary surface and the second primary surface.

17. The adjustable climbing wall of claim 14 further comprising a cover plate joined with the first panel and slidably engaged with the second panel, and wherein the slide is at least partially obscured as viewed from a distal end of the first panel, and wherein the cover plate comprises a first cover terminal limit housed in the first panel and a second cover terminal limit housed in the second panel.

18. A method of adjusting a climbing wall comprising:

receiving via a controller, a first input corresponding to a first distance between a first primary surface and a second primary surface, wherein:

the first primary surface substantially faces the second primary surface;

the first primary surface is movable along a slide having an extension element and a receiving element, the extension element joined with the first primary surface and the receiving element joined with the second primary surface, the extension element slidably engaged with the receiving element; and in response to the first input, positioning, via an actuator, the first primary surface to the first distance from the second primary surface, the actuator comprising a first actuator end and a second actuator end, the first actuator end joined with the first primary surface and the second actuator end joined with the second primary surface.

19. The method of claim 18, further comprising:

receiving by the controller, a second input corresponding to a second distance; and in response to the second input, positioning, via an actuator, the first primary surface to the second distance from the second primary surface.

20. The method of claim 18, wherein positioning comprises moving, via the actuator, the first primary surface by sliding the extension element along the receiving element.

* * * * *